US011396436B2

(12) United States Patent
Masunaga

(10) Patent No.: US 11,396,436 B2
(45) Date of Patent: Jul. 26, 2022

(54) CONVEYING DEVICE, IMAGE FORMING APPARATUS INCORPORATING THE CONVEYING DEVICE, AND METHOD OF CONVEYING A MEDIUM

(71) Applicant: Suguru Masunaga, Kanagawa (JP)

(72) Inventor: Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/953,287

(22) Filed: Nov. 19, 2020

(65) Prior Publication Data

US 2021/0155435 A1 May 27, 2021

(30) Foreign Application Priority Data

Nov. 21, 2019 (JP) ..... JP2019-210796
Oct. 2, 2020 (JP) ..... JP2020-167915

(51) Int. Cl.
*B65H 23/18* (2006.01)
*B65H 23/198* (2006.01)
(Continued)

(52) U.S. Cl.
CPC ..... *B65H 23/198* (2013.01); *B41J 15/16* (2013.01); *B41J 15/165* (2013.01);
(Continued)

(58) Field of Classification Search
CPC ..... B65H 23/198; B65H 23/1955; B65H 2403/942; B65H 2404/1452;
(Continued)

(56) References Cited

U.S. PATENT DOCUMENTS

2012/0267468 A1* 10/2012 Shiode ..... B41J 15/16 242/419.8
2015/0054898 A1 2/2015 Kondo et al.
(Continued)

FOREIGN PATENT DOCUMENTS

JP 2005-212916 8/2005
JP 2011-219222 11/2011
(Continued)

*Primary Examiner* — Yaovi M Ameh
(74) *Attorney, Agent, or Firm* — Duft & Bornsen, PC

(57) ABSTRACT

A conveying device includes a sheet conveyor configured to convey a medium in a conveyance direction of the medium, a sheet winder including a winding roller and a winding motor, and circuitry to control the sheet conveyor and the sheet winder. The circuitry is configured to convey the medium intermittently while repeating: causing the sheet conveyor and the sheet winder to convey the loosened medium by a predetermined conveyance amount; rotating the winding motor in a normal direction by a predetermined torque according to an outer winding diameter of the medium to apply a predetermined tension force to the medium; and rotating the winding motor in a reverse direction to loosen the medium by a predetermined slack amount. The circuitry is configured to determine the predetermined tension force according to the width of the medium intersecting with the conveyance direction of the medium.

9 Claims, 9 Drawing Sheets

(51) Int. Cl.
*B41J 15/16* (2006.01)
*B65H 23/195* (2006.01)

(52) U.S. Cl.
CPC ..... *B65H 23/1806* (2013.01); *B65H 23/1955* (2013.01); *B65H 2301/4493* (2013.01); *B65H 2403/942* (2013.01); *B65H 2404/1452* (2013.01); *B65H 2511/242* (2013.01); *B65H 2801/03* (2013.01); *B65H 2801/36* (2013.01)

(58) Field of Classification Search
CPC ..... B65H 2801/03; B65H 23/1806; B65H 2301/4493; B65H 2511/242; B65H 2801/36; B41J 15/165; B41J 15/16
See application file for complete search history.

(56) References Cited

U.S. PATENT DOCUMENTS

| | | | | |
|---|---|---|---|---|
| 2017/0266999 | A1* | 9/2017 | Hamano | B41J 13/0036 |
| 2017/0348988 | A1* | 12/2017 | Nakata | B41J 15/16 |
| 2020/0262221 | A1 | 8/2020 | Yokozawa et al. | |

FOREIGN PATENT DOCUMENTS

| | | |
|---|---|---|
| JP | 2015-227231 | 12/2015 |
| JP | 2016-016946 | 2/2016 |

* cited by examiner

CONVEYING DEVICE, IMAGE FORMING APPARATUS INCORPORATING THE CONVEYING DEVICE, AND METHOD OF CONVEYING A MEDIUM

CROSS-REFERENCE TO RELATED APPLICATIONS

This patent application is based on and claims priority pursuant to 35 U.S.C. § 119(a) to Japanese Patent Application Nos. 2019-210796, filed on Nov. 21, 2019, and 2020-167915, filed on Oct. 2, 2020, in the Japan Patent Office, the entire disclosure of each of which is hereby incorporated by reference herein.

BACKGROUND

Technical Field

Embodiments of the present disclosure relate to a conveying device, an image forming apparatus incorporating the conveying device, and a method of conveying a medium.

Background Art

Various types of serial-type inkjet image forming apparatuses, a winding mechanism is employed to wind a roll type medium after image formation. Such a roll type medium is wound with a constant torque via a torque limiter, with application of constant tension from a tension bar disposed upstream from a winding unit, or with other different method.

Further, a known image forming apparatus that performs the following control prevents skew (misaligned winding) due to misalignment of a winding shaft of a winder. The known image forming apparatus causes the winding unit to start taking up the roll type medium after a certain time has elapsed from the start of conveyance by a conveyance unit. By so doing, the known image forming apparatus conveys the roll type medium with a certain slack amount, in other words, while the roll type medium is loosened.

However, in recent years, the types and shapes of media have diversified. In addition, the behavior during conveyance of the medium differs depending on the type of the medium. Therefore, the known slack control may cause insufficient tension force or excessive tension force depending on the type of a medium.

SUMMARY

Embodiments of the present disclosure described herein provide a novel conveying device including a sheet conveyor, a sheet winder, and circuitry. The sheet conveyor is configured to convey a medium in a conveyance direction of the medium. The sheet winder includes a winding roller and a winding motor. The winding roller is disposed downstream from the sheet conveyor in the conveyance direction and is configured to wind the medium. The winding motor is configured to rotate the winding roller. The circuitry is configured to control an operation performed by the sheet conveyor and an operation performed by the sheet winder. The circuitry is configured to convey the medium intermittently while repeating a first operation to cause the sheet conveyor and the sheet winder to convey the medium by a predetermined conveyance amount while the medium is loosened between the sheet conveyor and the sheet winder, a second operation to rotate the winding motor in a normal direction by a predetermined torque according to an outer winding diameter of the medium wound around the winding roller, while the sheet conveyor is stopped, to apply a predetermined tension force to the medium between the sheet conveyor and the sheet winder, and a third operation to rotate the winding motor in a reverse direction opposite the normal direction to loosen the medium by a predetermined slack amount while the predetermined tension force is applied to the medium. The circuitry is configured to determine the predetermined tension force according to the width of the medium intersecting with the conveyance direction of the medium.

Further, embodiments of the present disclosure described herein provide an image forming apparatus including the above-described conveying device and an image forming unit configured to form an image on the medium between the sheet conveyor and the sheet winder.

Further, embodiments of the present disclosure described herein provide a conveying device including a sheet conveyor, a sheet winder, and circuitry. The sheet conveyor is configured to convey a medium in a conveyance direction of the medium. The sheet winder includes a winding roller and a winding motor. The winding roller is disposed downstream from the sheet conveyor in the conveyance direction and is configured to wind the medium. The winding motor is configured to rotate the winding roller. The circuitry is configured to control an operation performed by the sheet conveyor and an operation performed by the sheet winder. The circuitry is configured to convey the medium intermittently while repeating a first operation to cause the sheet conveyor and the sheet winder to convey the medium by a predetermined conveyance amount while the medium is loosened between the sheet conveyor and the sheet winder, a second operation to rotate the winding motor in a normal direction by a predetermined torque according to an outer winding diameter of the medium wound around the winding roller, while the sheet conveyor is stopped, to apply a predetermined tension force to the medium between the sheet conveyor and the sheet winder, and a third operation to rotate the winding motor in a reverse direction opposite the normal direction to loosen the medium by a predetermined slack amount while the predetermined tension force is applied to the medium. The circuitry is configured to determine the predetermined slack amount according to the width of the medium intersecting with the conveyance direction of the medium.

Further, embodiments of the present disclosure described herein provide an image forming apparatus that includes the above-described conveying device and an image forming unit configured to form an image on the medium between the sheet conveyor and the sheet winder.

Further, embodiments of the present disclosure described herein provides a method of conveying a medium. The method includes causing a sheet conveyor configured to convey the medium in a conveyance direction of the medium and a sheet winder including a winding roller configured to wind the medium and a winding motor configured to rotate the winding roller, to convey the medium by a predetermined conveyance amount while the medium is loosened between the sheet conveyor and the sheet winder, rotating the winding motor in a normal direction while the sheet conveyor is stopped, to apply a predetermined tension force to the medium between the sheet conveyor and the sheet winder, rotating the winding motor in a reverse direction opposite the normal direction to loosen the medium by a predetermined slack amount while the predetermined tension force is applied to the medium, and repeating the causing, the rotating the winding motor in the normal direction, and the rotating the winding motor in the reverse direction to convey the medium intermittently.

BRIEF DESCRIPTION OF THE SEVERAL VIEWS OF THE DRAWINGS

Exemplary embodiments of this disclosure will be described in detail based on the following figures, wherein.

Figure 1:
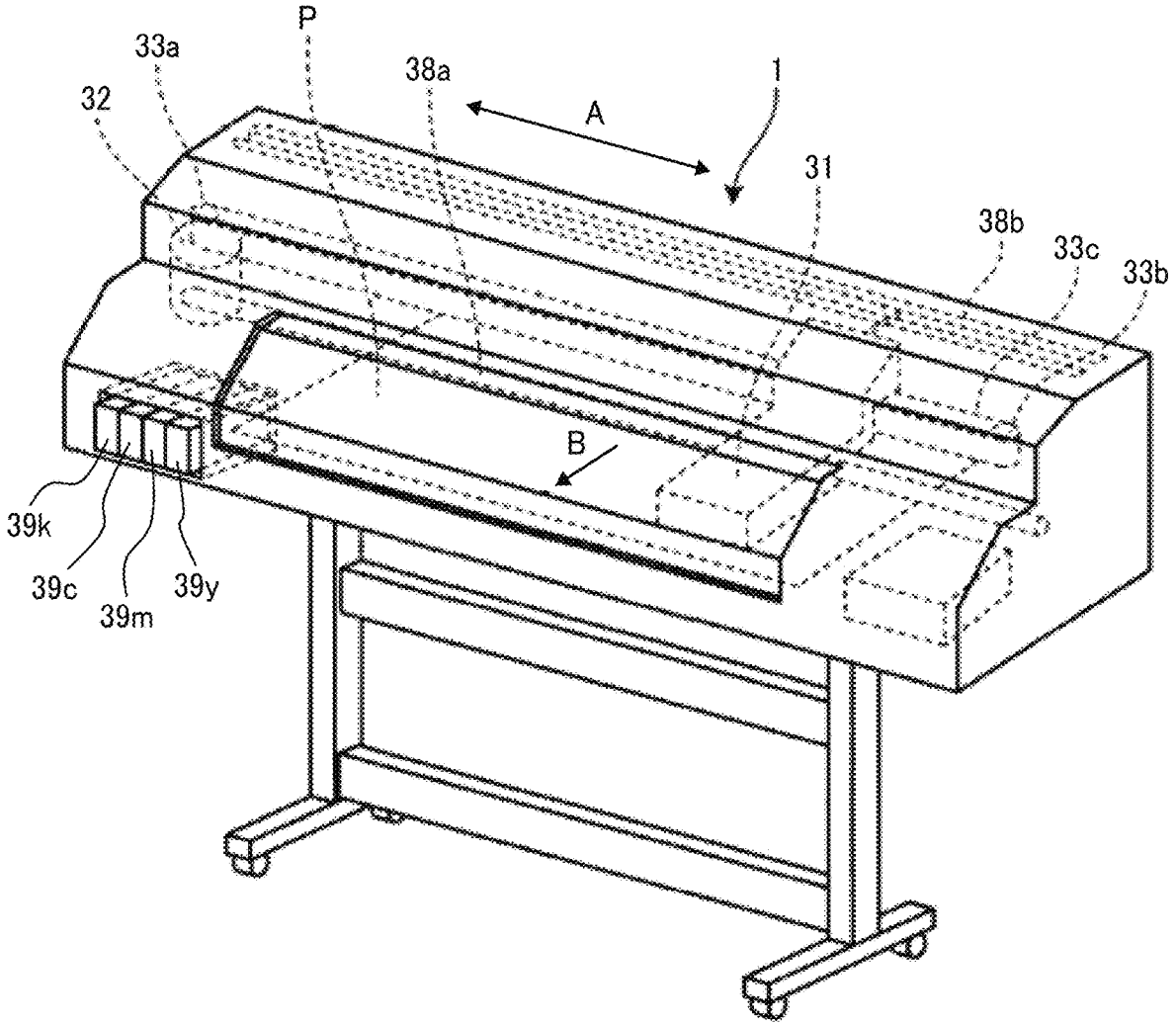
FIG. 1 is a perspective view illustrating a configuration of an image forming apparatus according to the present embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

EMBODIMENT OF THE PRESENT DISCLOSURE

Hereinafter, the image forming apparatus 1 according to an embodiment of the present disclosure will be described with reference to FIGS. 1 to 5.

FIG. 1 is a perspective view illustrating a configuration of an image forming apparatus 1 according to the present embodiment of the present disclosure.

Figure 2:
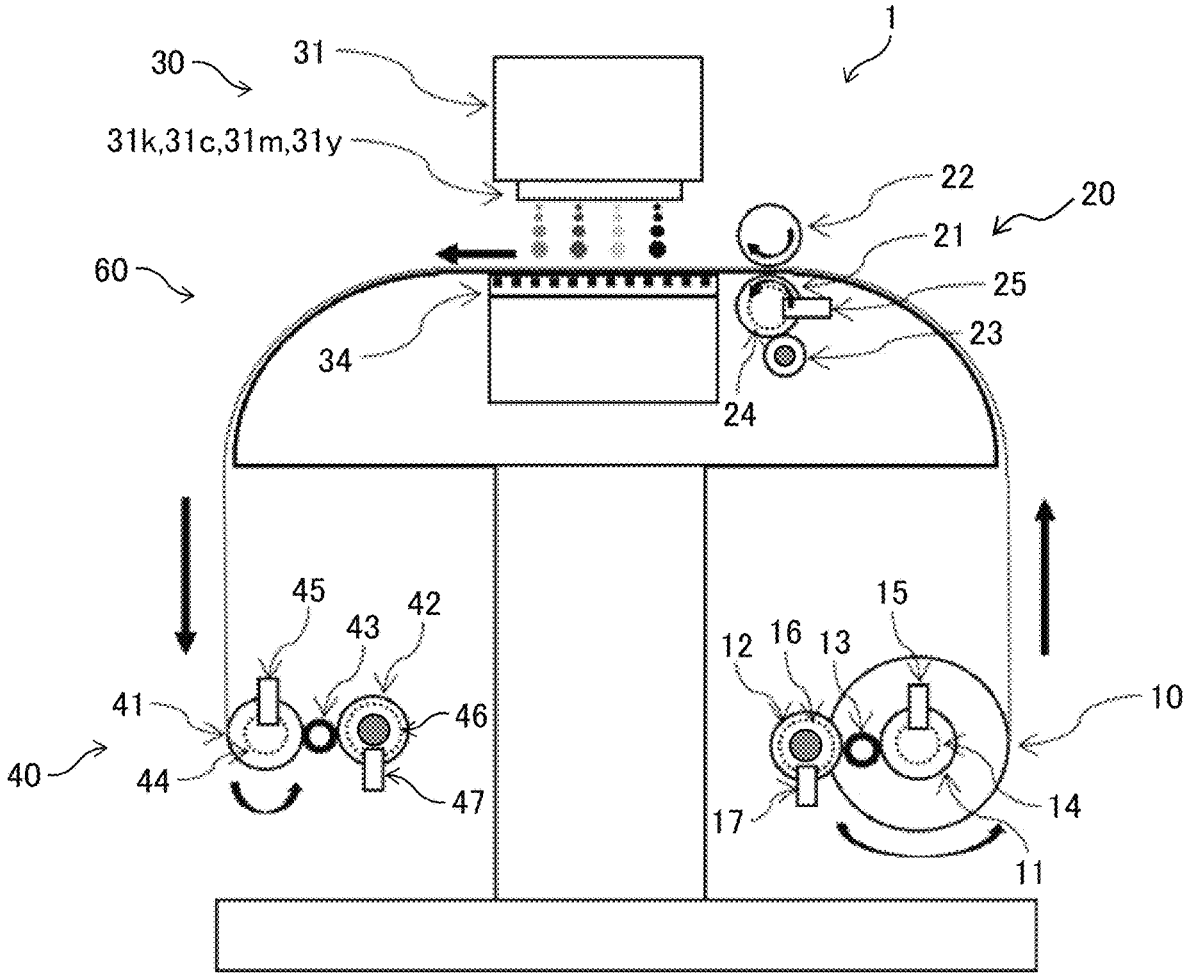
FIG. 2 is a cross-sectional view illustrating the internal configuration of the image forming apparatus of FIG. 1.

FIG. 2 is a cross-sectional view illustrating the internal configuration of the image forming apparatus 1 of FIG. 1.

Figure 3:
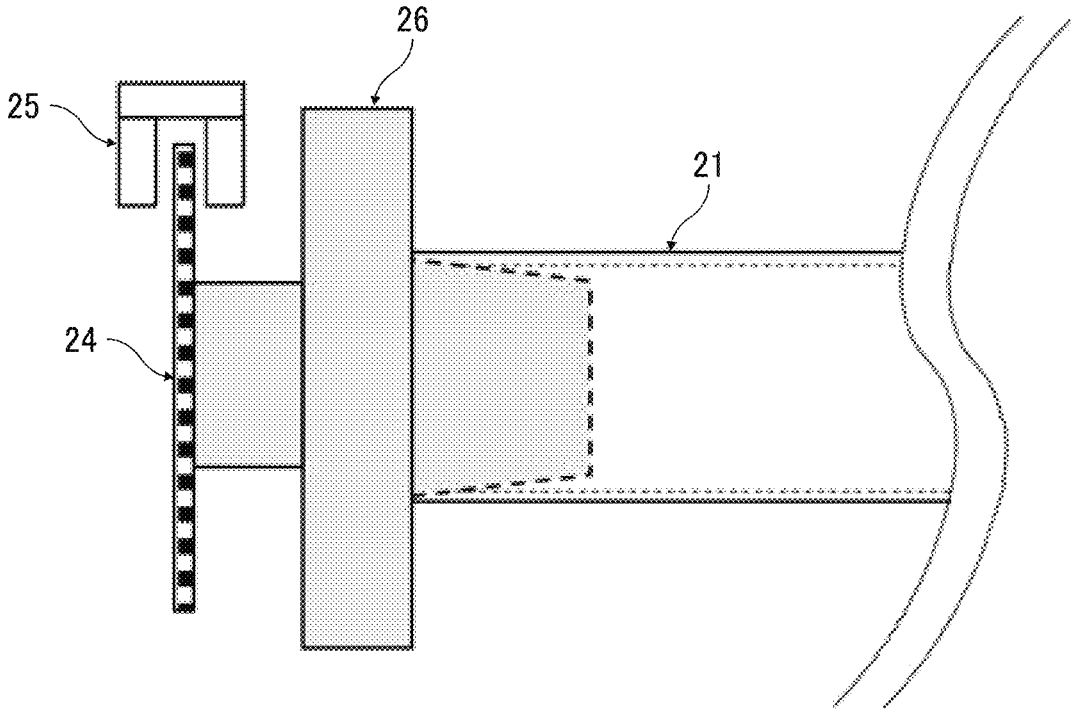
FIG. 3 is a diagram illustrating a detailed configuration of a sheet conveyor provided to the image forming apparatus of FIG. 1.

FIG. 3 is a diagram illustrating a detailed configuration of a sheet conveyor 20 provided to the image forming apparatus 1 of FIG. 1.

Figure 4:
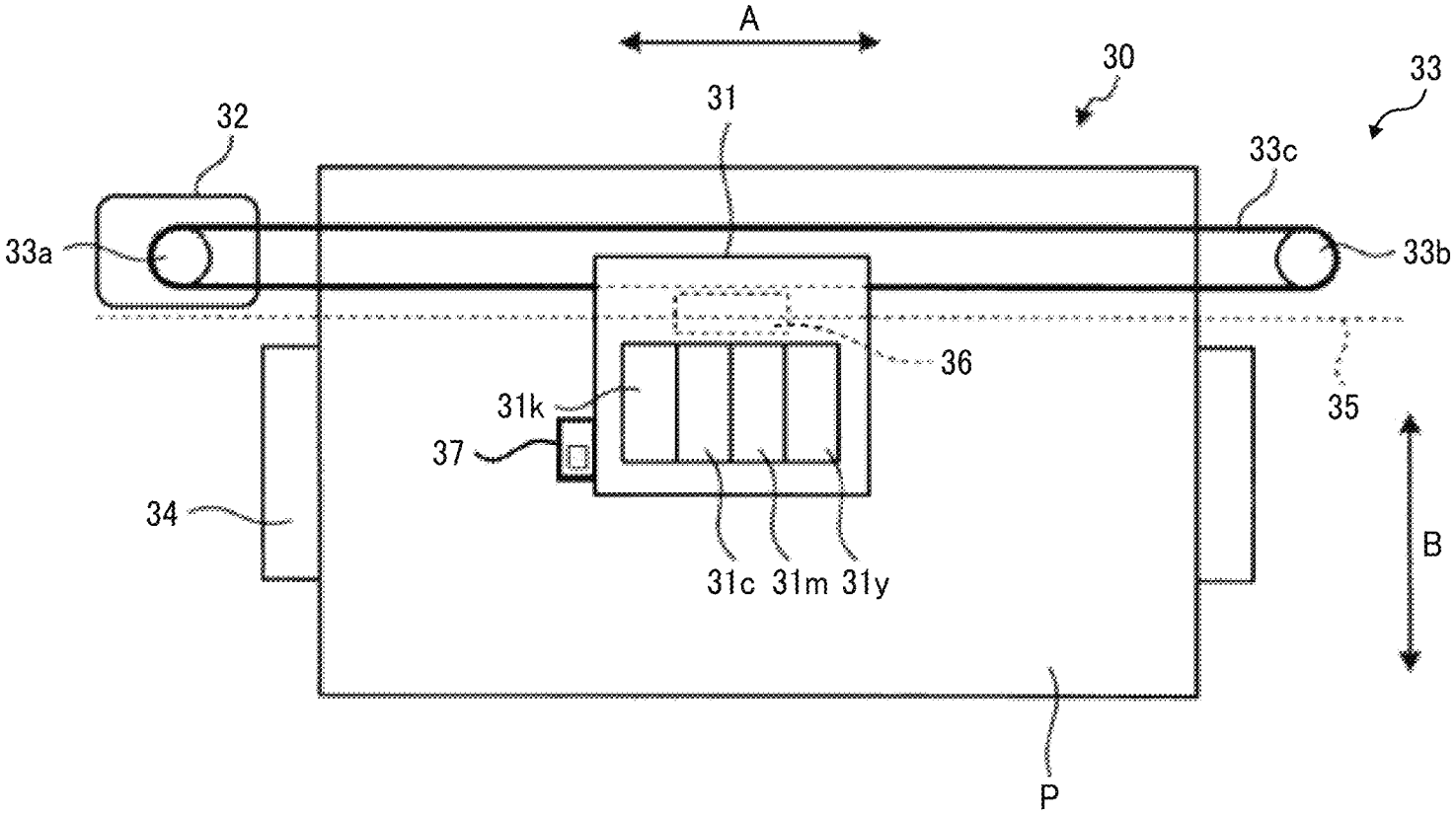
FIG. 4 is a plan view illustrating a detailed configuration of an image forming device provided in the image forming apparatus of FIG. 1.

FIG. 4 is a plan view illustrating a detailed configuration of an image forming device provided in the image forming apparatus 1 of FIG. 1.

Figure 5:
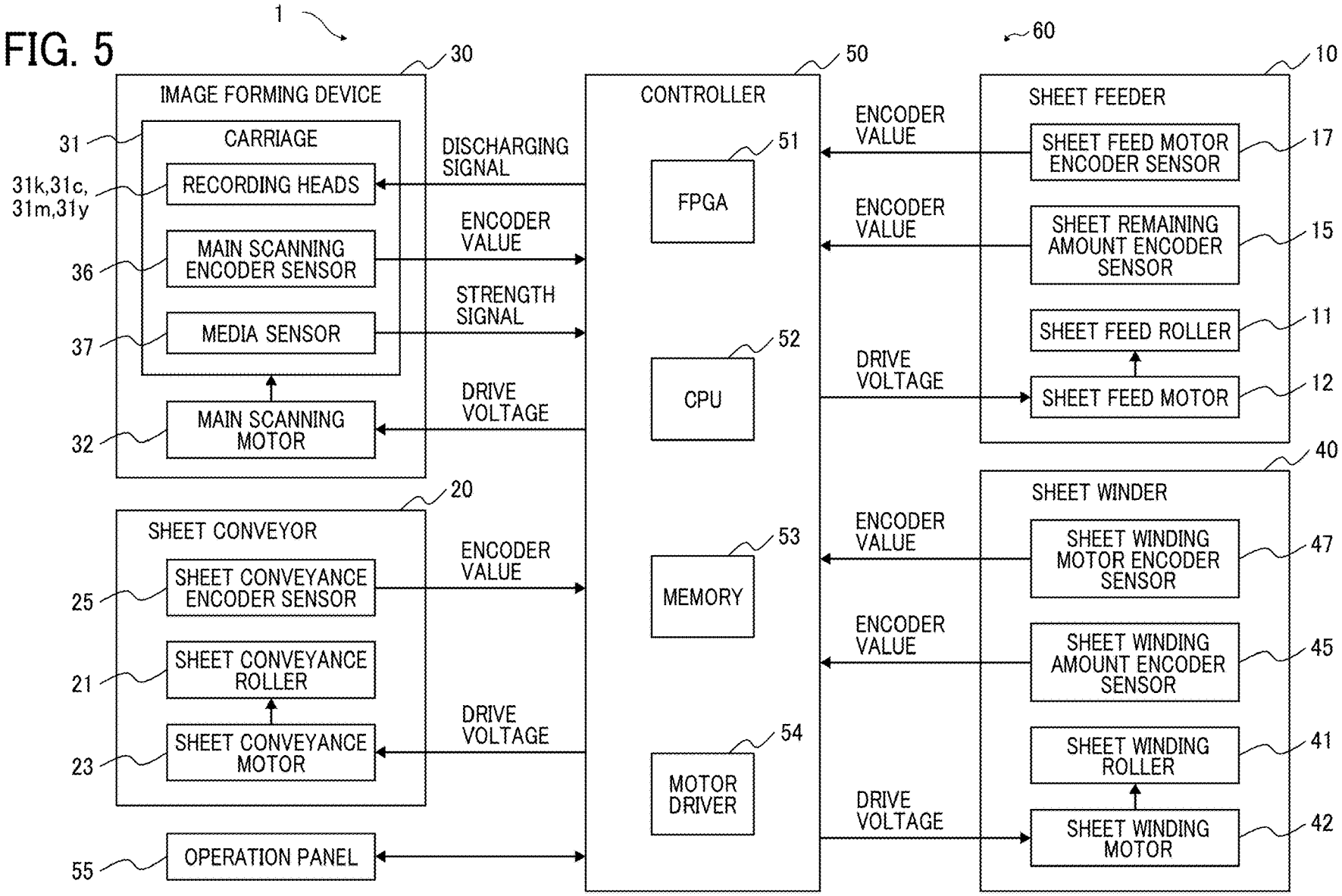
FIG. 5 is a block diagram illustrating the image forming apparatus of FIG. 1.

FIG. 5 is a block diagram of the image forming apparatus 1 of FIG. 1.

The image forming apparatus 1 according to the present embodiment is an inkjet image forming apparatus that forms an image on the continuous sheet P that is a strip-shaped medium by discharging ink onto the continuous sheet P. However, the image forming method performed in the image forming apparatus 1 is not limited to the inkjet method and may be an electrophotographic method. The image forming apparatus 1 mainly includes a sheet feeder 10, a sheet conveyor 20, an image forming device 30, a sheet winder 40, and a controller 50 that functions as circuitry.

The sheet feeder 10 applies a predetermined tension force to the continuous sheet P between the sheet feeder 10 and the sheet conveyor 20. The sheet feeder 10 mainly includes a sheet feeding roller 11, a sheet feed motor 12, a torque limiter 13, a sheet remaining encoder sheet 14, a sheet remaining encoder sensor 15, a sheet motor encoder sheet 16, and a sheet feed motor encoder sensor 17.

The continuous sheet P before bearing an image is wound around the sheet feeding roller 11. The sheet feed motor 12 rotates the sheet feeding roller 11 by application of drive voltage caused by the controller 50. The torque limiter 13 manages the upper limit of the torque to be transmitted from the sheet feed motor 12 to the sheet feeding roller 11.

The sheet remaining encoder sheet 14 rotates together with the sheet feeding roller 11 as a single unit. The sheet remaining encoder sensor 15 reads the number of rotations of the sheet remaining encoder sheet 14 and outputs the pulse signal indicating the read number of rotations of the sheet remaining encoder sheet 14, to the controller 50. The sheet motor encoder sheet 16 rotates together with the output shaft of the sheet feed motor 12 as a single unit. The sheet feed motor encoder sensor 17 reads the number of rotations of the sheet motor encoder sheet 16 and outputs the pulse signal indicating the read number of rotations of the sheet motor encoder sheet 16, to the controller 50.

The sheet feeder 10 rotates the sheet feeding roller 11 in a sheet winding direction in which the continuous sheet P held between a sheet conveyance roller 21 and a pressure roller 22 is wound. As a result, the image forming apparatus 1 applies a predetermined tension force that corresponds to the upper limit value of the torque set in the torque limiter 13, to the continuous sheet P between the sheet feeder 10 and the sheet conveyor 20.

The sheet conveyor 20 conveys the continuous sheet P fed from the sheet feeder 10 to the sheet winder 40 via a position facing the image forming device 30. The sheet conveyor mainly includes the sheet conveyance roller 21, the pressure roller 22, a sheet conveyance motor 23, a sheet conveyance encoder sheet 24, and a sheet conveyance encoder sensor 25.

The sheet conveyance roller 21 and the pressure roller 22 rotate while holding the continuous sheet P from both sides in a thickness direction of the continuous sheet P. Further, as illustrated in FIG. 3, the sheet conveyance roller 21 is provided with flanges 26 at both ends. Each flange 26 contacts a widthwise end of the continuous sheet P, in other words, an end in the width direction of the continuous sheet P. The flange 26 on the left end of the sheet conveyance roller 21 is illustrated in FIG. 3. Note that the flange 26 on the right end of the sheet conveyance roller 21 is identical to the flange 26 on the left end of the sheet conveyance roller 21 in the configuration and function. As the sheet conveyance motor 23 transmits the driving force via the torque limiter 13, the sheet conveyance roller 21 and the flanges 26 receive the driving force and rotate. The pressure roller 22 is pressed by the sheet conveyance roller 21 by application of a predetermined pressure and is rotated with rotation of the sheet conveyance roller 21.

The sheet conveyance encoder sheet 24 rotates together with the sheet conveyance roller 21 and the flanges 26 as a single unit. The sheet conveyance encoder sensor 25 reads the number of rotations of the sheet conveyance encoder sheet 24 and outputs the pulse signal indicating the read number of rotations of the sheet conveyance encoder sheet 24, to the controller 50.

The image forming device 30 is disposed downstream from the sheet conveyor 20 in the sheet conveyance direction of the continuous sheet P. The image forming device 30 discharges ink to the continuous sheet P that is conveyed by the sheet conveyor 20 in a sub-scanning direction B, so that an image is formed on the continuous sheet P. As illustrated in FIGS. 1, 2, and 4, the image forming device 30 mainly includes a carriage 31, a main scanning motor 32, a drive force transmission mechanism 33, a platen 34, a main scanning encoder sheet 35, a main scanning encoder sensor 36, and a media sensor 37.

As illustrated in FIGS. 1 and 4, the carriage 31 reciprocally moves along a guide rod 38*a* and a sub-guide rail 38*b*, both extending in a main scanning direction A (i.e., the width direction of the continuous sheet P) perpendicular to the sub-scanning direction B (i.e., the sheet conveyance direction of the continuous sheet P). In other words, the width direction of the continuous sheet P intersects with the sheet conveyance direction of the continuous sheet P. Further, recording heads 31*k*, 31*c*, 31*m*, and 31*y* that discharge inks of respective colors (that is, black, cyan, magenta, and yellow) are mounted on the carriage 31. The recording heads 31*k*, 31*c*, 31*m*, and 31*y* discharge the inks supplied from ink cartridges 39*k*, 39*c*, 39*m*, and 39*y*, respectively, toward the continuous sheet P that is supported by the platen 34. Note that the main scanning direction A corresponds to the width direction of the continuous sheet P is perpendicular to (intersects with) the sub-scanning direction B that corresponds to the sheet conveyance direction of the continuous sheet P.

As the drive force transmission mechanism 33 transmits the driving force of the main scanning motor 32 to the carriage 31, the carriage 31 moves in the main scanning direction A. To be more specific, the drive force transmission mechanism 33 includes a drive pulley 33*a*, a pressure pulley 33*b*, and a timing belt 33*c*. The drive pulley 33*a* and the pressure pulley 33*b* are disposed spaced apart in the main scanning direction A. The timing belt 33*c* is an endless loop wound around the drive pulley 33*a* and the pressure pulley 33*b*.

As the main scanning motor 32 transmits the driving force to the drive pulley 33*a*, the drive pulley 33*a* rotates. Along with rotation of the drive pulley 33*a*, the timing belt 33*c* is rotated to reciprocally move the carriage 31 mounted on the timing belt 33*c* in the main scanning direction A. Further, the pressure pulley 33*b* applies a predetermined tension to the timing belt 33*c*.

The platen 34 is disposed facing the carriage 31 in the vertical direction. Then, the platen 34 supports the continuous sheet P conveyed by the sheet conveyor 20. Further, the platen 34 has a color having the reflectance of light lower than the reflectance of light of the continuous sheet P. For example, the continuous sheet P is white while the platen 34 is black.

The main scanning encoder sheet 35 is extended in the main scanning direction A at the position facing the carriage 31. The main scanning encoder sensor 36 is mounted on the carriage 31. Further, the main scanning encoder sensor 36 reads the main scanning encoder sheet 35 and outputs the pulse signal indicating the read number of rotations of the main scanning encoder sheet 35, to the controller 50.

The media sensor 37 emits light toward the platen 34 or the continuous sheet P that is supported by the platen 34 and receives the reflection light reflected on the platen 34 or the continuous sheet P. Then, the media sensor 37 outputs a signal of intensity indicating the intensity of the received reflection light, to the controller 50. The media sensor 37 is used, for example, to detect the widthwise end of the continuous sheet P, in other words, the end in the width direction of the continuous sheet P.

The sheet winder 40 is disposed downstream from the sheet conveyor 20 and the image forming device 30 in the sheet conveyance direction of the continuous sheet P. The sheet winder 40 winds the continuous sheet P on which an image is formed by the image forming device 30. The sheet winder 40 includes a sheet winding roller 41, a sheet winding motor 42, a torque limiter 43, a winding amount encoder sheet 44, a winding amount encoder sensor 45, a winding motor encoder sheet 46, and a winding motor encoder sensor 47.

The sheet winding roller 41 winds the continuous sheet P after image formation, in other words, the continuous sheet P on which an image is formed. The sheet winding motor 42 rotates the sheet winding roller 41 by applying a drive voltage from the controller 50. The torque limiter 43 manages the upper limit of the torque transmitted from the sheet winding motor 42 to the sheet winding roller 41.

The winding amount encoder sheet 44 rotates together with the sheet winding roller 41. The winding amount encoder sensor 45 reads the number of rotations of the winding amount encoder sheet 44 and outputs the pulse signal indicating the read number of rotations of the winding amount encoder sheet 44, to the controller 50. The winding motor encoder sheet 46 rotates together with the output shaft of the sheet winding motor 42 as a single unit. The winding motor encoder sensor 47 reads the number of rotations of the winding motor encoder sheet 46 and outputs the pulse signal indicating the read number of rotations of the winding motor encoder sheet 46, to the controller 50.

The controller 50 controls the operation of the image forming apparatus 1. To be more specific, the controller 50 controls the operations of the sheet feeder 10, the sheet conveyor 20, the image forming device 30, the sheet winder 40, and a control panel (operation unit) 55. By so doing, an image is formed on the continuous sheet P.

As illustrated in FIG. 5, the controller 50 mainly includes a field-programmable gate array (FPGA) 51, a central processing unit (CPU) 52, a memory 53, and a motor driver 54. The CPU 52 reads and executes the program stored in the memory 53. Such processing configures a software controller including various functional modules of the image forming apparatus 1. The software controller thus configured cooperates with hardware resources of the image forming apparatus 1 construct functional blocks to implement functions, illustrated as functional blocks, of the image forming apparatus 1. In addition, the image forming apparatus 1 may use the FPGA 51 to implement the function customized for each of separate image forming apparatuses 1.

The controller 50 rotates each of the sheet feed motor 12, the sheet conveyance motor 23, the main scanning motor 32, and the sheet winding motor 42 by applying a drive voltage via the motor driver 54. Further, the controller 50 outputs a discharge signal to each of the recording heads 31*k*, 31*c*, 31*m*, and 31*y*, so as to cause the recording heads 31*k*, 31*c*, 31*m*, and 31*y* to discharge ink.

Further, the controller 50 acquires pulse signals from the sheet remaining encoder sensor 15, the sheet feed motor encoder sensor 17, the sheet conveyance encoder sensor 25, the main scanning encoder sensor 36, the winding amount encoder sensor 45, and the winding motor encoder sensor 47. Further, the controller 50 counts the pulse signals acquired from the sheet remaining encoder sensor 15, the sheet feed motor encoder sensor 17, the sheet conveyance encoder sensor 25, the main scanning encoder sensor 36, the winding amount encoder sensor 45, and the winding motor encoder sensor 47. Hereinafter, the number of pulse signals counted by the controller 50 is referred to as an "encoder value". Then, the controller 50 determines the number of rotations of each motor and the amount of movement of the carriage 31, based on the encoder value.

Further, in the course of movement of the carriage 31 in the main scanning direction A, the controller 50 detects the position of the end of the continuous sheet P in the main scanning direction A (i.e., the width direction), based on the change of the signal of intensity that is output from the media sensor 37. To be more specific, in the course of movement of the carriage 31 from the left to the right in FIG. 4, the controller 50 detects the position at which the signal of intensity has changed from a point less than the threshold to a point equal to or greater than the threshold, as the left end of the continuous sheet P. Further, in the course of movement of the carriage 31 from the left to the right in FIG. 4, the controller 50 detects the position at which the signal of intensity has changed from a point equal to or greater than the threshold to a point less than the threshold, as the right end of the continuous sheet P.

The control panel 55 includes, for example, a display for displaying an image, a touch panel for detecting an input operation by an operator who presses buttons displayed on the display, and a push button pressed by the operator. The controller 50 displays an image on the display. Further, the controller 50 acquires an operation signal corresponding to the input operation by the operator pressing the buttons on the touch panel or the push button, through the control panel 55.

Next, a description is given of the image forming process, with reference to FIGS. 6 to 9.

Figure 6:
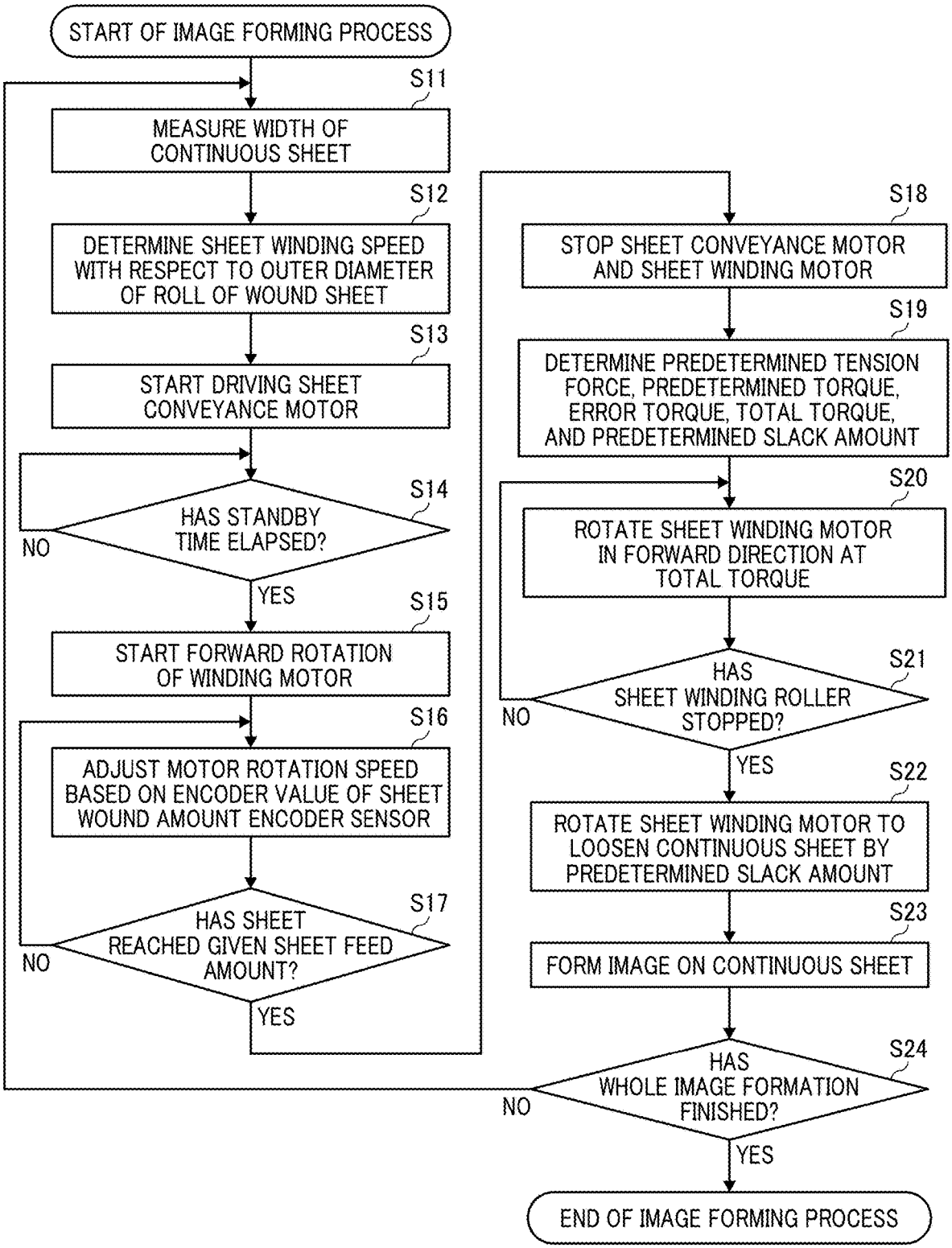
FIG. 6 is a flowchart of an image forming process performed in the image forming apparatus of FIG. 1.

FIG. 6 is a flowchart of the image forming process performed in the image forming apparatus 1 of FIG. 1.

FIGS. 7A, 7B, 7C, and 7D are diagrams each illustrating the state of the continuous sheet P disposed between the sheet conveyor 20 and the sheet winder 40 of the image forming apparatus 1 of FIG. 1, at each step of image forming process in the flowchart of FIG. 6.

Figure 8A:
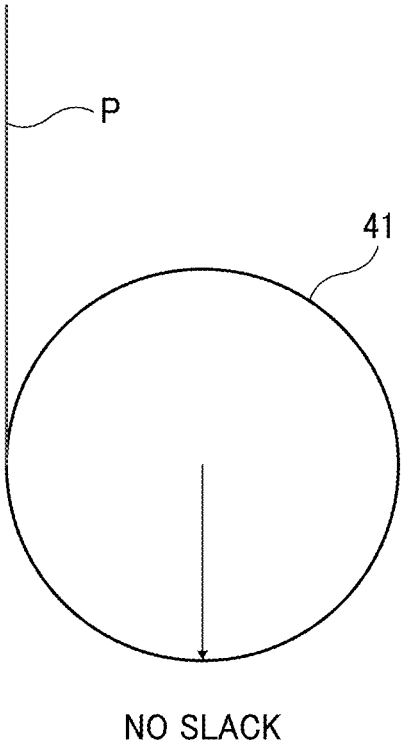
FIGS. 8A and 8B are diagrams for explaining a method of specifying a slack amount.
Figure 8B:
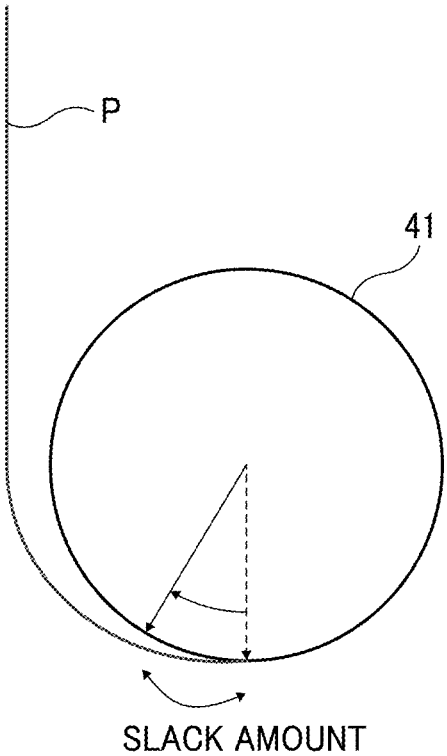

FIGS. 8A and 8B are diagrams for explaining a method of specifying the slack amount when the continuous sheet P is loosened by the sheet winder 40.

Figure 9:
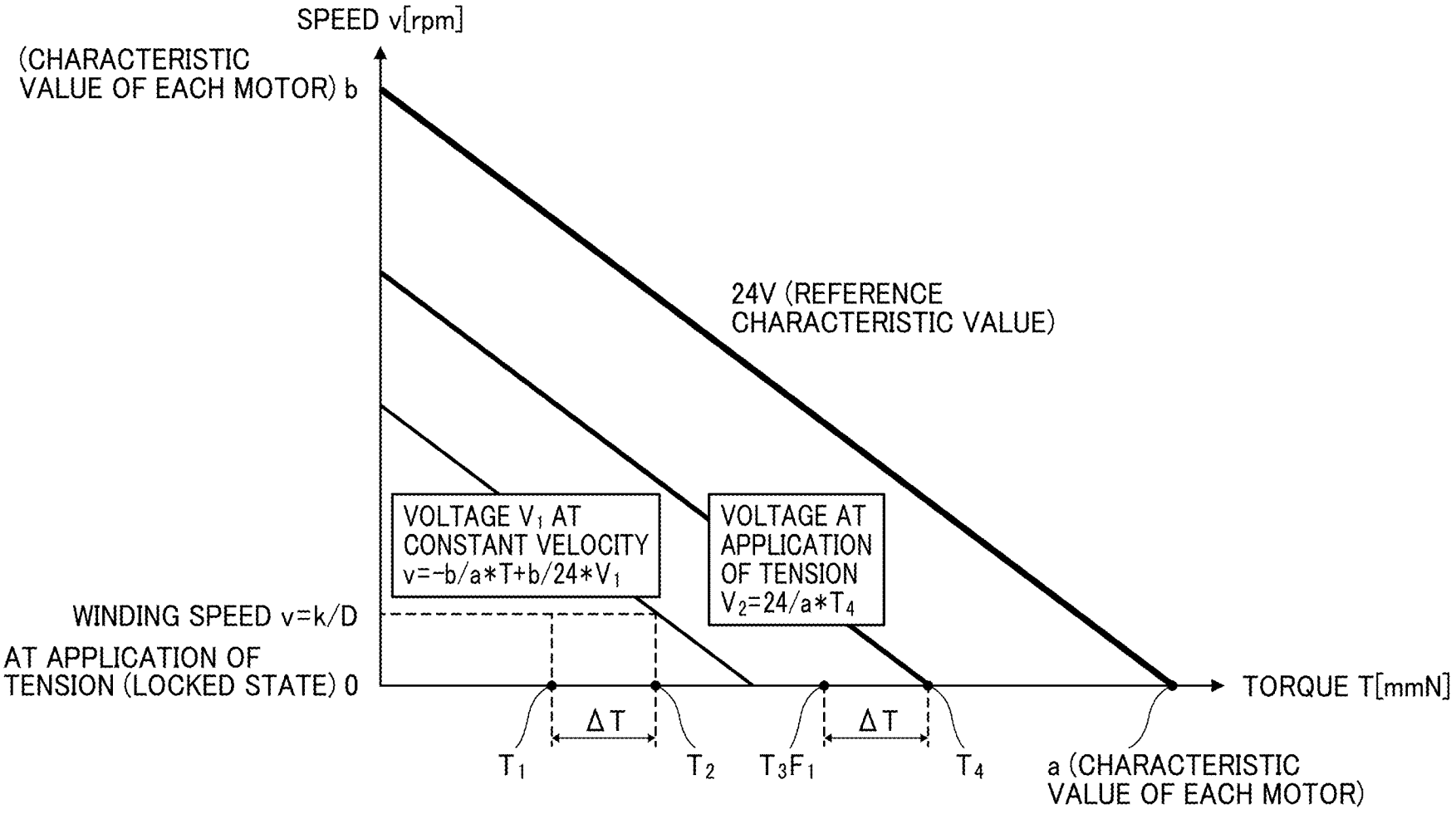
FIG. 9 is a diagram of the T-N curve of a winding motor.

FIG. 9 is a diagram of the T-N curve of the sheet winding motor 42. The T-N curve is stored in the memory 53.

The T-N curve illustrated in FIG. 9 indicates the characteristics of the sheet winding motor 42 that is actually measured in the assembly process of the image forming apparatus 1.

Note that the controller 50 stores the integrated value of the encoder value of the sheet conveyance encoder sensor 25 since the continuous sheet P is set on the sheet feeding roller 11 and the sheet winding roller 41, in the memory 53 that stores the T-N curve. Hereinafter, this integrated value is referred to as the "integrated conveyance amount". That is, the controller 50 adds the encoder value of the sheet conveyance encoder sensor 25 through steps S13 to S18, to the integrated conveyance amount, to reset the integrated conveyance amount at the timing to replace the continuous sheet P.

Figure 7A:
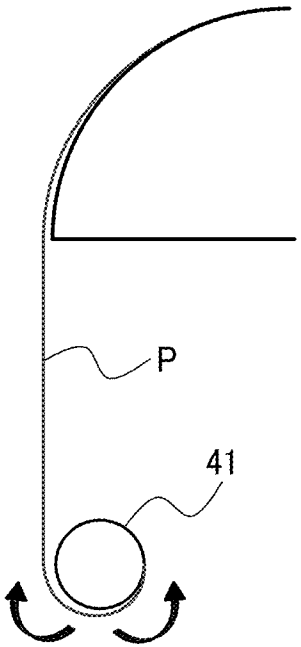
FIGS. 7A, 7B, 7C, and 7D are diagrams each illustrating the state of a continuous sheet disposed between the sheet conveyor and a sheet winder of the image forming apparatus of FIG. 1.

Further, as illustrated in FIG. 7A, the continuous sheet P is loosened by the predetermined slack amount, between the sheet conveyor 20 and the sheet winder 40, the start of the image forming process. Further, the controller 50 monitors the encoder value of the winding amount encoder sensor 45 until step S15 is executed, and causes the sheet winding motor 42 to rotate in a direction to correct the change of the slack amount of the continuous sheet P (I.e., a positioning stop control).

First, the controller 50 measures the length of the continuous sheet P in the main scanning direction A (that is, the width "w" of the continuous sheet P), based on the encoder value of the main scanning encoder sensor 36 and the signal of intensity of the media sensor 37 (step S11). Note that, in a case in which the width "w" of the continuous sheet P has already been measured, the controller 50 may skip the process of step S11.

Specifically, the controller 50 drives the main scanning motor 32 to move the carriage 31 in the main scanning direction A, so as to detect the left end and the right end of the continuous sheet P. Then, the controller 50 specifies the width "w" of the continuous sheet P based on the encoder value of main scanning encoder sensor 36 from detection of the left end of the continuous sheet P to detection of the right end of the continuous sheet P. That is, the controller 50 specifies the width "w" of the continuous sheet P by multiplying the distance of movement of the carriage 31 at the interval of the pulse signals output from the main scanning encoder sensor 36, by the above-described encoder value.

Next, in order to synchronize the operation of the sheet conveyor 20 and the operation of the sheet winder 40 for conveying the continuous sheet P, the controller 50 determines the sheet winding speed "v" according to the outer diameter of the continuous sheet P wound around the sheet winding roller 41. The outer diameter of the continuous sheet P is hereinafter referred to as the "outer winding diameter D" (step S12). The sheet winding speed "v" is the rotational speed of the sheet winding roller 41 that rotates in synchrony with the rotation of the sheet conveyance roller 21.

To be more specific, the controller 50 determines the current outer winding diameter D [mm] based on the integrated conveyance amount stored in the memory 53, the thickness of the continuous sheet P, and the outer diameter of the sheet winding roller 41. Then, the controller 50 determines the sheet winding speed "v" [rpm] using the following Equation 1. The constant "k" is a value previously determined and set based on the conveying speed of the continuous sheet P by the sheet conveyor 20 and is previously stored in the memory 53.

$$v=k/D \qquad \text{Equation 1.}$$

Figure 7B:
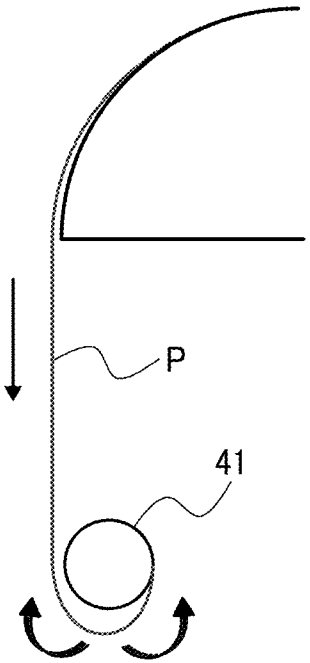

Next, the controller 50 starts driving the sheet conveyance motor 23 at the predetermined speed in a state in which the sheet winding motor 42 is stopped (step S13). Then, the controller 50 determines whether the predetermined standby time has elapsed (step S14). When the predetermined standby time has not elapsed (NO in step S14), the controller 50 continues (repeats) this state until a predetermined standby time elapses. Accordingly, as illustrated in FIG. 7B, the slack amount of the continuous sheet P between the sheet conveyor and the sheet winder 40 increases as the time elapses. Further, the standby time is assumed to be previously set within the range, for example, between 100 ms and 500 ms (typically, 200 ms).

Next, when the predetermined standby time has elapsed from the start of driving of the sheet conveyance motor 23 (YES in step S14), the controller 50 starts the sheet winding motor 42 to rotate in the normal direction to rotate the sheet winding roller 41 at the sheet winding speed "v" determined in step S12 (step S15). Here, a direction of rotation of the sheet winding motor 42 to rotate the sheet winding roller 41 in the direction to wind the continuous sheet P is defined as a "normal rotation" and a direction of rotation of the sheet winding motor 42 to rotate the sheet winding roller 41 in the direction opposite the direction to wind the continuous sheet P is defined as a "reverse rotation."

Here, the sheet winding speed "v" determined in step S12 is a value that matches the conveyance amount of the continuous sheet P by the sheet conveyor 20 and the wound amount of the continuous sheet P by the sheet winder 40. In the actual operation, however, the conveyance amount of the continuous sheet P by the sheet conveyor 20 and the wound amount of the continuous sheet P by the sheet winder 40 do not match exactly, for example, susceptible to an error due to eccentricity of the shaft of the sheet winding roller 41 and an error in the size of the outer winding diameter D.

Figure 7C:
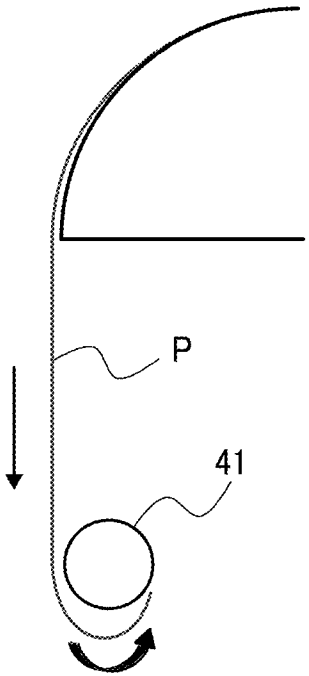

Therefore, the controller 50 determines, in step S17, whether the conveyance amount of the continuous sheet P by the sheet conveyor 20 has reached the predetermined conveyance amount. When the conveyance amount of the continuous sheet P by the sheet conveyor 20 has not reached the predetermined conveyance amount (NO in step S17), the process goes back to step S16 and the controller 50 performs the feedback control of the rotational speed of the sheet winding motor 42 based on the encoder value of the winding amount encoder sensor in step S16. Accordingly, as illustrated in FIG. 7C, the sheet winding roller 41 winds the continuous sheet P while the slack amount of the continuous sheet P between the sheet conveyor 20 and the sheet winder 40 is maintained.

To be more specific, the controller 50 may increase or decrease the drive voltage applied to the sheet winding motor 42 so as to approach the sheet winding speed "v" determined based on the encoder value of the winding amount encoder sensor 45. Further, the controller 50 stores the drive voltage $V_1$ [V] converged by the feedback control, in the memory 53.

On the other hand, when the sheet conveyor 20 has conveyed the continuous sheet P by the predetermined conveyance amount, in other words, when the conveyance amount of the continuous sheet P by the sheet conveyor 20 has reached the predetermined conveyance amount (YES in step S17), the controller 50 stops the sheet conveyance motor 23 and the sheet winding motor 42 (step S18). At this time, the slack amount of the continuous sheet P between the sheet conveyor 20 and the sheet winder 40 is equal to the slack amount of the continuous sheet P at the start of step S15. Next, the controller 50 determines the predetermined tension force $F_1$ [N], the predetermined torque $T_3$ [mmN], the error torque $\Delta T$ [mmN], the total torque $T_4$ [mmN], and the predetermined slack amount [mm] (step S19).

The predetermined tension force $F_1$ refers to the tension force applied to the continuous sheet P between the sheet conveyor 20 and the sheet winder 40 in steps S20 and S21 described below. The controller 50 determines a predetermined tension force $F_1$ by using, for example, the following Equation 2. Note that the above-described "determination" includes, for example, calculation of the tension force based on a predetermined calculation equation and determination of the tension force by referring to the "medium width-tension force table" previously stored in the memory. The same conditions are applied to the "determination" of other values.

The reference width $w_0$ [mm] refers to the width of the reference continuous sheet P in the main scanning direction A. The reference tension force $F_0$ [N] refers to the predetermined tension force applied to the continuous sheet P having the reference width $w_0$. That is, the controller 50 determines the predetermined tension force $F_1$ according to the width of the continuous sheet P. To be more specific, the controller 50 increases the predetermined tension force $F_1$ as the width of the continuous sheet P increases.

$$F_1=F_0\times(w/w_0) \qquad \text{Equation 2.}$$

The predetermined torque $T_3$ is a theoretical value of the torque to be generated by the sheet winding motor 42 in order to apply the predetermined tension force $F_1$ to the continuous sheet P. The controller 50 determines the predetermined torque $T_3$ by using the following Equation 3. That is, the controller 50 determines the predetermined torque $T_3$ according to the current outer winding diameter D. To be more specific, the controller 50 determines the predetermined torque $T_3$ according to the predetermined tension force $F_1$ and the current outer winding diameter D. More specifically, the controller 50 increases the predetermined torque $T_3$ as the predetermined tension force $F_1$ increases and increases the predetermined torque $T_3$ as the outer winding diameter D increases.

$$T_3=F_1\times(D/2) \qquad \text{Equation 3.}$$

The error torque $\Delta T$ is the difference of the theoretical value of the torque to be generated by the sheet winding motor 42 (that is, a theoretical torque $T_1$) to achieve the winding speed "v" and the actual value (that is, the actual torque $T_2$) of the torque that is actually generated by the sheet winding motor 42 in step S16. The theoretical torque $T_1$ [mmN] is a predetermined theoretical torque that is previously stored in the memory 53. On the other hand, the controller 50 uses Equation 4, for example, to determine the actual torque $T_2$ [mmN], and uses Equation 5 to determine the error torque ΔT.

As described in Equation 4, the actual torque $T_2$ is a value corresponding to the drive voltage $V_1$ that has actually been applied to the sheet winding motor 42 in order to synchronize and operate the sheet conveyor 20 and the sheet winder 40. Note that, in Equation 4, the restraint torque "a" [mmN] corresponds to the restraint torque on the T-N curve stored in the memory 53, that is, the value on the horizontal axis of the graph illustrated in FIG. 9. Further, in Equation 4, the number of unloaded rotations "b" [rpm] corresponds to the number of unloaded rotations on the T-N curve stored in the memory 53, that is, the value on the vertical axis of the graph illustrated in FIG. 9. The number "24" is a constant [V] represents the drive voltage at the restraint torque "a" and the number of unloaded rotations "b".

$$T_1=\{(b/24)\times V_1-v\}\times a/b \quad \text{Equation 4.}$$

$$\Delta T=T_2-T_1 \quad \text{Equation 5.}$$

The total torque $T_4$ is a value obtained by adding the predetermined torque $T_3$ and the error torque ΔT. That is, the total torque $T_4$ is a predetermined torque $T_3$ corrected by the error torque ΔT. In other words, the total torque $T_4$ is the actual value of the torque that should be generated by the sheet winding motor 42 (that is, a value considering variation in each image forming apparatus 1) to apply the predetermined tension force $F_1$ to the continuous sheet P. The controller 50 determines the total torque $T_4$ using Equation 6.

$$T_4=T_3+\Delta T \quad \text{Equation 6.}$$

The predetermined slack amount is the amount of loosening the continuous sheet P between the sheet conveyor 20 and the sheet winder 40 in step S22. The controller 50 determines the predetermined slack amount according to the width of the continuous sheet P. To be more specific, the controller 50 increases the predetermined slack amount as the width of the continuous sheet P decreases.

Next, the controller 50 causes the sheet winding motor 42 to rotate in the normal direction, in other words, perform the normal rotation, at the total torque $T_4$ that is determined in step S19 while the sheet conveyance motor 23 is stopped, in step S20. Then, based on the encoder value of the winding amount encoder sensor 45, the controller 50 continues the normal rotation of the sheet winding motor 42 until the sheet winding roller 41 stops rotating (NO in step S21). The drive voltage $V_2$ [V] that is applied to the sheet winding motor 42 in step S20 is calculated using Equation 7, for example.

$$V_2=(24/a)\times T_4 \quad \text{Equation 7.}$$

Figure 7D:
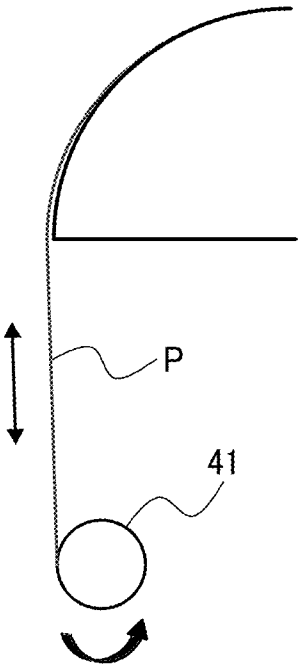

As a result, the slack of the continuous sheet P between the sheet conveyor 20 and the sheet winder 40 gradually decreases. Then, as illustrated in FIG. 7D, when the slack amount of the continuous sheet P comes to zero (0), the sheet conveyor 20 and the sheet winder 40 pull the continuous sheet P taut. Further, when the predetermined tension force $F_1$ is applied to the continuous sheet P between the sheet conveyor 20 and the sheet winder 40, the sheet winding motor 42 is locked to stop rotation of the sheet winding roller 41. For example, the controller 50 may determine that the sheet winding roller 41 has stopped because the pulse signal is not continuously output from the winding amount encoder sensor 45 for a predetermined period of time.

Next, the controller 50 stops the normal rotation of the sheet winding motor 42 when the rotation of the sheet winding roller 41 is stopped (YES in step S21). Then, the controller 50 causes the sheet winding motor 42 to rotate in reverse, so as to loosen the continuous sheet P to which the predetermined tension force $F_1$ is applied, by the predetermined slack amount (step S22). Accordingly, as illustrated in FIG. 7A, the continuous sheet P is loosened by the predetermined slack amount, between the sheet conveyor 20 and the sheet winder 40.

As illustrated in FIG. 8, the slack amount of the continuous sheet P corresponds to the number of rotations of the sheet winding roller 41 in the direction in which the continuous sheet P is unwound. Therefore, based on the current outer winding diameter D and the encoder value of the winding amount encoder sensor 45, the controller 50 cause the sheet winding motor 42 to rotate in the reverse direction until the sheet winding roller 41 rotates by the number of rotations corresponding to the predetermined slack amount. Then, after the continuous sheet P is loosened by the predetermined slack amount, the controller 50 executes the positioning stop control until the controller 50 starts the process in step S15.

Next, the controller 50 forms an image in the area on the continuous sheet P that faces the image forming device 30 (step S23). To be more specific, the controller 50 drives the main scanning motor 32 to move the carriage 31 in the main scanning direction A and outputs a discharge signal to the recording heads 31*k*, 31*c*, 31*m*, and 31*y* at the predetermined timings. The output timing of the discharge signal changes depending on the image recorded on the continuous sheet P.

Next, the controller 50 determines whether the whole image formation to the continuous sheet P is finished (step S24). When the controller 50 determined that the image formation has not yet been finished (NO in step S24), the controller 50 executes the processes in and after step S11. That is, the controller 50 executes the processes of steps S11 to S22 repeatedly to convey the continuous sheet P intermittently by the predetermined conveyance amount of the continuous sheet P. Then, when the controller 50 determined that the image formation has been finished (YES in step S24), the controller 50 completes the image forming process.

According to the above-described embodiment, the following operational effects, for example, are achieved.

In step S13, the controller 50 according to the above-described embodiment causes the sheet conveyor 20 to start conveyance of the continuous sheet P while the continuous sheet P is loosened (step S22). Accordingly, the image forming apparatus 1 prevents occurrence of shock applied at the start of conveyance of the continuous sheet P as well as skew caused by the difference in tension force in the width direction of the continuous sheet P. As a result, the image forming apparatus 1 enhances the stable conveyance quality. Further, since the controller 50 applies the predetermined tension force $F_1$ to the continuous sheet P, and then loosens the continuous sheet P (steps S20 and S21 (YES) to step S22). Therefore, the appropriate slack amount is set to the continuous sheet P.

Further, the controller 50 according to the above-described embodiment determines the predetermined torque $T_3$ applied to the sheet winding motor 42 in step S20, according to the outer winding diameter D. Accordingly, a constant tension force is applied to the continuous sheet P regardless of the wound amount of the sheet winding roller 41.

Note that, as the width "w" of the continuous sheet P decreases, the tension force per unit width increases. Therefore, as in the above-described embodiment, the controller 50 adjusts the predetermined tension force $F_1$ according to the width "w" of the continuous sheet P, the constant tension force per unit width is maintained regardless of the width "w" of the continuous sheet P.

Further, when the width "w" of the continuous sheet P is relatively small, when compared with a case in which the width "w" of the continuous sheet P is relatively large, the tension force remains even if the continuous sheet P is loosened. Therefore, as in the above-described embodiment, the controller 50 adjusts the predetermined slack amount according to the width "w" of the continuous sheet P, the sheet conveyor 20 starts conveyance of the continuous sheet P while no tension force remains in the continuous sheet P.

Further, the controller 50 according to the above-described embodiment executes the positioning stop control after the continuous sheet P is loosened by the predetermined slack amount. Accordingly, the constant slack amount of the continuous sheet P is provided when the sheet conveyor 20 starts conveyance of the continuous sheet P. As a result, the positional deviation of the continuous sheet P on the platen 34 is prevented, and therefore the image forming apparatus 1 forms an image at the appropriate position in step S23.

Further, due to individual differences in the image forming apparatus 1, for example, the eccentricity of the shaft of the sheet winding roller 41, even if the sheet winding motor 42 rotates at the ideal value of the predetermined torque $T_3$, the tension force applied to the continuous sheet P varies for each image forming apparatus 1. Therefore, as in the above embodiment, the controller 50 corrects the predetermined torque $T_3$ with the error torque $\Delta T$, which is the difference between the theoretical torque $T_1$ and the actual torque $T_2$. Accordingly, individual differences in the image forming apparatus 1 are absorbed, and a constant tension force is applied to the continuous sheet P.

Further, as in the above-described embodiment, the controller 50 executes various processes in step S19 based on the T-N curve created in the manufacturing process of the image forming apparatus 1. Accordingly, the controller 50 absorbs the individual difference of the image forming apparatus 1 to calculate a correct value.

Note that the above-described embodiment has described an example in which the controller 50 adjusts both the predetermined tension force $F_1$ and the predetermined slack amount. However, the controller 50 may adjust at least one of the predetermined tension force $F_1$ and the predetermined slack amount. As an example, the controller 50 may provide the predetermined slack amount as a fixed value in the above-described embodiment. As another example, the controller 50 may adjust the predetermined slack amount alone when the constant tension force is applied to the continuous sheet P via the torque limiter 43.

Further, the above-described embodiment has described an example in which the controller 50 determines the predetermined tension force $F_1$ and the predetermined slack amount according to the width "w" of the continuous sheet P. However, the controller 50 may determine the predetermined tension force $F_1$ and the predetermined slack amount based on a parameter other than the width of the continuous sheet P. As another example, the controller 50 may determine the predetermined tension force $F_1$ according to the rigidity of the continuous sheet P. That is, as the rigidity of the continuous sheet P increases, the controller 50 may increase the predetermined tension force $F_1$ and the predetermined slack amount. The width "w" of the continuous sheet P and the rigidity of the continuous sheet P are examples of the "types of a medium".

Further, the above-described embodiment has described an example in which the controller 50 determines the predetermined tension force $F_1$ based on the controller 50. However, an operator of the image forming apparatus 1 may adjust the predetermined tension force. To be more specific, the control panel 55 may receive an input by an operator to increase or decrease the tension force to be applied to the continuous sheet P. Then, the controller 50 may increase or decrease (in other words, adjust) the predetermined tension force $F_1$ determined in step S19 according to the operation on the control panel 55 by the operator.

According to the above-described variation, when the whole image formation on the continuous sheet P is completed and the continuous sheet P is conveyed to the subsequent process, the winding amount of the continuous sheet P is set appropriately.

Further, in the above-described embodiments and variation, the present disclosure is applied to the image forming apparatus 1. However, the present disclosure may be widely applied to a conveying device that conveys the continuous sheet P. The conveying device includes the conveying device 60 including the sheet feeder 10, the sheet conveyor 20, the sheet winder 40, the controller 50, and the control panel 55, as described above. Further, the strip-shaped medium is not limited to the continuous sheet P. For example, as long as the medium is strip-shaped, a cloth or a resin film may be applied.

Note that the present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the present disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A conveying device comprising:

a sheet conveyor configured to convey a medium in a conveyance direction of the medium;

a sheet winder including:

a winding roller downstream from the sheet conveyor in the conveyance direction, the winding roller being configured to wind the medium; and a winding motor configured to rotate the winding roller; and circuitry configured to control an operation performed by the sheet conveyor and an operation performed by the sheet winder, the circuitry being configured to convey the medium intermittently while repeating:

a first operation to cause the sheet conveyor and the sheet winder to convey the medium by a predetermined conveyance amount while the medium is loosened between the sheet conveyor and the sheet winder;

a second operation to rotate the winding motor in a normal direction by a predetermined torque according to an outer winding diameter of the medium that is wound around the winding roller, while the sheet conveyor is stopped, to apply a predetermined tension force to the medium between the sheet conveyor and the sheet winder; and a third operation to rotate the winding motor in a reverse direction opposite the normal direction while the predetermined tension force is applied to the medium to loosen the medium by a predetermined slack amount, the circuitry being configured to determine the predetermined tension force according to a width of the medium intersecting with the conveyance direction of the medium.

2. The conveying device according to claim 1, wherein the circuitry is configured to increase the predetermined tension force as the width of the medium increases.

3. The conveying device according to claim 1, wherein the circuitry is configured to:

determine an error torque as a difference between an actual torque corresponding to a drive voltage that is applied to the winding motor to rotate in synchrony with the sheet conveyor and the sheet winder and a predetermined theoretical torque; and rotate the winding motor at the predetermined torque corrected by the error torque to apply the predetermined tension force to the medium between the sheet conveyor and the sheet winder.

4. The conveying device according to claim 3, further comprising a memory configured to store a T-N curve of the winding motor, wherein the circuitry is configured to:

determine the actual torque based on the T-N curve; and apply a drive voltage to the winding motor, the drive voltage corresponding to the predetermined torque having been corrected by the error torque on the T-N curve.

5. The conveying device according to claim 1, wherein the circuitry is configured to increase the predetermined slack amount as the width of the medium decreases.

6. The conveying device according to claim 1, further comprising an operation unit configured to receive an input operation to increase and decrease a tension force applied to the medium, wherein the circuitry is configured to adjust the predetermined tension force according to the input operation to the operation unit.

7. An image forming apparatus comprising:

the conveying device according to claim 1; and an image forming device configured to form an image on the medium between the sheet conveyor and the sheet winder.

8. A method of conveying a medium, the method comprising:

causing a sheet conveyor and a sheet winder to convey the medium in a conveyance direction by a predetermined conveyance amount while the medium is loosened between the sheet conveyor and the sheet winder;

determining a predetermined tension force according to a width of the medium intersecting with the conveyance direction of the medium;

rotating a winding motor of the sheet winder in a normal direction by a predetermined torque according to an outer winding diameter of the medium that is wound around a winding roller, while the sheet conveyor is stopped, to rotate the winding roller to apply the predetermined tension force to the medium between the sheet conveyor and the sheet winder;

rotating the winding motor in a reverse direction opposite the normal direction while the predetermined tension force is applied to the medium, to rotate the winding roller in reverse to loosen the medium by a predetermined slack amount; and repeating the causing, the rotating the winding motor in the normal direction, and the rotating the winding motor in the reverse direction to convey the medium intermittently.

9. The method of conveying the medium according to claim 8, further comprising determining the predetermined slack amount according to a width of the medium intersecting with the conveyance direction of the medium.

* * * * *